US009188304B2

(12) United States Patent
Fadi et al.

(10) Patent No.: US 9,188,304 B2
(45) Date of Patent: Nov. 17, 2015

(54) AUTOMOTIVE LIGHT

(71) Applicant: AUTOMOTIVE LIGHTING ITALIA S.p.A., Venaria Reale (IT)

(72) Inventors: Denis Fadi, Venaria Reale (IT); Sara Paroni, Codroipo (IT); Marco Svettini, Venaria Reale (IT)

(73) Assignee: Automotive Lighting Italia S.p.A., Venaria Reale (IT)

( * ) Notice: Subject to any disclaimer, the term of this patent is extended or adjusted under 35 U.S.C. 154(b) by 0 days.

(21) Appl. No.: 14/193,882

(22) Filed: Feb. 28, 2014

(65) Prior Publication Data

US 2014/0247615 A1 Sep. 4, 2014

(30) Foreign Application Priority Data

Mar. 1, 2013 (IT) ..... TV2013A0033

(51) Int. Cl.
*F21V 9/00* (2015.01)
*F21S 8/10* (2006.01)

(52) U.S. Cl.
CPC ..... *F21S 48/2281* (2013.01); *F21S 48/215* (2013.01); *F21S 48/225* (2013.01); *F21S 48/2237* (2013.01); *F21S 48/2243* (2013.01); *F21S 48/2262* (2013.01); *F21S 48/2268* (2013.01)

(58) Field of Classification Search
CPC ..... F21S 48/2225; F21S 48/2237; F21S 48/2243; F21S 48/2262; F21S 48/2268; B60Q 1/30; B60Q 1/0052
USPC ..... 362/511
See application file for complete search history.

(56) References Cited

U.S. PATENT DOCUMENTS

| | | | | |
|---|---|---|---|---|
| 6,769,798 | B2 * | 8/2004 | Mishimagi | 362/522 |
| 2003/0147253 | A1 * | 8/2003 | Shy | 362/545 |
| 2014/0056016 | A1 * | 2/2014 | Marcori et al. | 362/487 |

FOREIGN PATENT DOCUMENTS

| | | |
|---|---|---|
| EP | 2071228 | 6/2009 |
| EP | 2354637 | 8/2011 |
| EP | 2541128 | 1/2013 |
| JP | 2006236588 | 9/2006 |
| WO | WO 2013008215 | 1/2013 |

* cited by examiner

*Primary Examiner* — Andrew Coughlin
(74) *Attorney, Agent, or Firm* — McCarter & English, LLP

(57) ABSTRACT

An automotive light including a substantially basin-shaped rear body structured so to be fixed onto the vehicle body; a front lenticular semi-shell provided with at least one band-like, transparent or semi-transparent portion; and at least a first lighting assembly, which is structured so as to emit light when electrically powered and is arranged so as to backlight the band-like; the first lighting assembly including: a first light-guiding plate made of photoconductive material which extends from the bottom of the rear body up to/close to the front lenticular semi-shell, while remaining perpendicular to the front lenticular semi-shell; and a second light-guiding plate made of photoconductive material, which laterally rests on/is joined with one of the two larger faces of the first light-guiding plate, close to the front lateral side of the same first light-guiding plate, so as to form an L-shaped structure which extends tangentially to the front lenticular semi-shell.

16 Claims, 3 Drawing Sheets

AUTOMOTIVE LIGHT

The present invention relates to an automotive light.

More in detail, the present invention relates to a rear light for cars, use to which the following description will make explicit reference without this implying any loss in generality.

BACKGROUND OF THE INVENTION

As is known, the car rear lights usually consist of a rigid rear body which is substantially basin-like in shape and is structured so as be firmly fitted into a specially provided seat made in the rear of the vehicle's body; a front lenticular semi-shell which is at least partially made of a transparent or semi-transparent plastic material, usually coloured, and which is placed to close the mouth of the body so as to surface from the vehicle's body; one or more cup-shaped reflectors with a more or less parabolic profile, each of which is located inside the rear body with its mouth facing a corresponding transparent or semi-transparent portion of the front lenticular semi-shell; and one or more incandescent lamps, each of which is arranged close to the bottom of a respective cup-shaped reflector so as to backlight a portion of the front lenticular semi-shell directly above the same cup-shaped reflector.

In some models of car rear lights, the front lenticular semi-shell is also provided with one or more supplementary transparent or semi-transparent portions having a narrow and elongated shape, i.e. a band-like shape, which usually flanks the main transparent or semi-transparent portion(s) of the front lenticular semi-shell, i.e. the transparent or semi-transparent portions aligned with the mouths of the cup-shaped reflectors.

The backlighting of each supplementary band-like, transparent or semi-transparent portion of the front lenticular semi-shell is usually achieved by means of a light-guiding plate made of a photoconductive material, which more or less has a thickness equal to the width of the supplementary band-like portion, extends from the bottom of the casing almost up to the back of the front lenticular semi-shell, locally remaining substantially perpendicular to the lenticular semi-shell, and is then shaped such that its front lateral side is located just behind the supplementary band-like portion of the semi-shell for the entire length of the same portion; and a row of light emitting diodes, traditionally called LEDs, which are located on the bottom of the body, resting on the rear lateral side of the light-guiding plate, and are orientated so as direct the light produced towards the inside of the plate through the latter's rear lateral side. Light that then travels inside the body of the light-guiding plate according to the same physical principles that govern light propagation in fibre-optic cables and finally comes out of the light-guiding plate through the front lateral side of the same plate.

Although guaranteeing a significant cost saving with respect to a backlighting system that uses an array of LEDs located immediately beneath the supplementary band-like, transparent or semi-transparent portion of the lenticular semi-shell, the backlighting system with a light-guiding plate does not allow making supplementary band-like, transparent or semi-transparent portions wider than 10-15 millimetres because the thickness of the light-guiding plate would reach values incompatible with the constructional specifications for the rear lights of cars.

SUMMARY OF THE INVENTION

Aim of the present invention is that of providing cars rear lights devoid of the constructional limits inherent in the backlighting system with light-guiding plate.

In compliance with the above aims, according to the present invention there is provided an automotive light as specified in claim 1 and preferably, though not necessarily, in any of its dependent claims.

BRIEF DESCRIPTION OF THE DRAWINGS

The present invention will now be described with reference to the attached drawings, which illustrate a non-limitative embodiment, where:

FIG. 3 is a perspective view of part of the automotive light shown in FIGS. 1 and 2, with parts removed for clarity; while

DETAILED DESCRIPTION OF THE INVENTION

Figure 1:
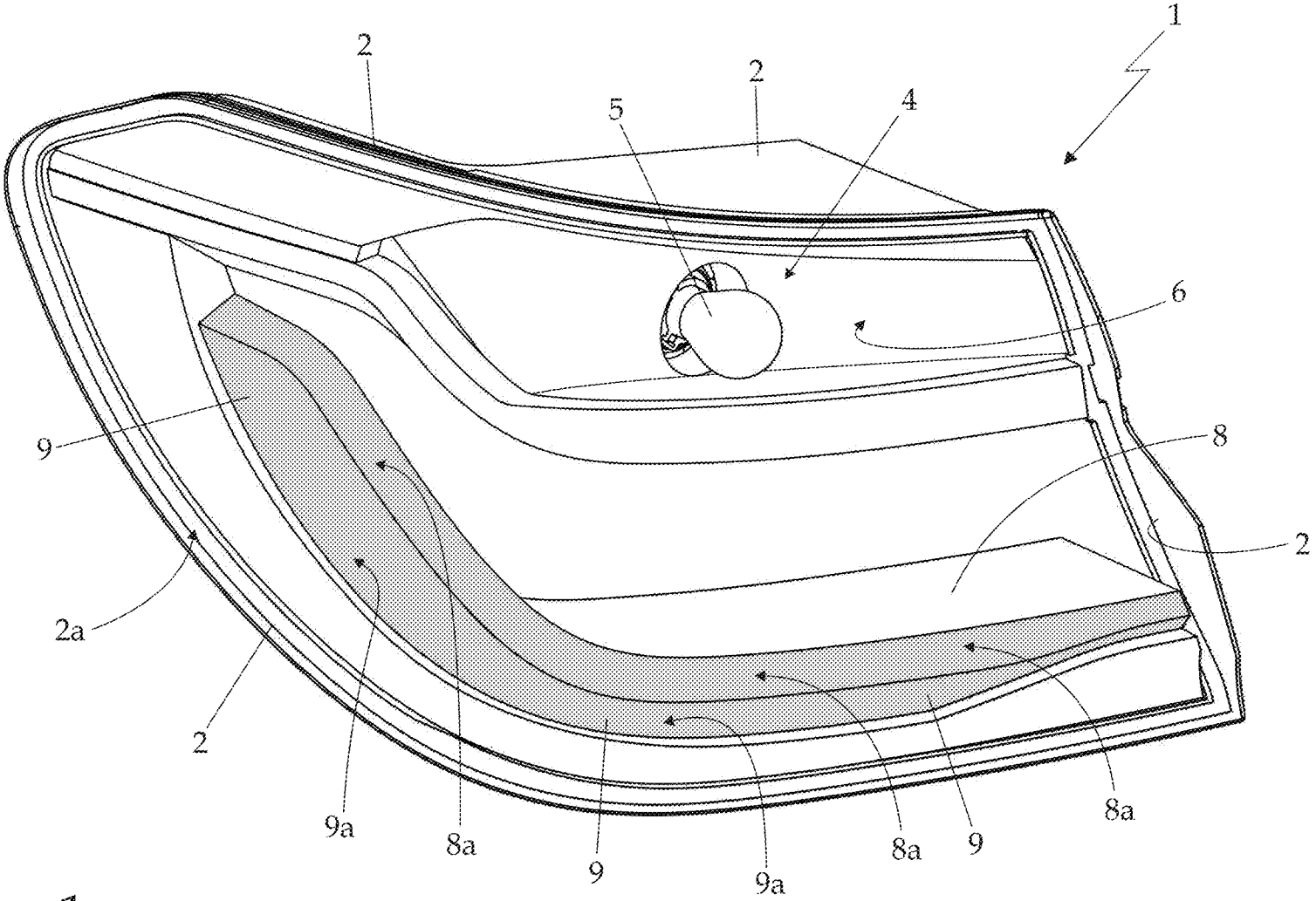
FIG. 1 is an axonometric view of a rear light for cars made according to the principles of the present invention, with parts removed for clarity.
Figure 2:
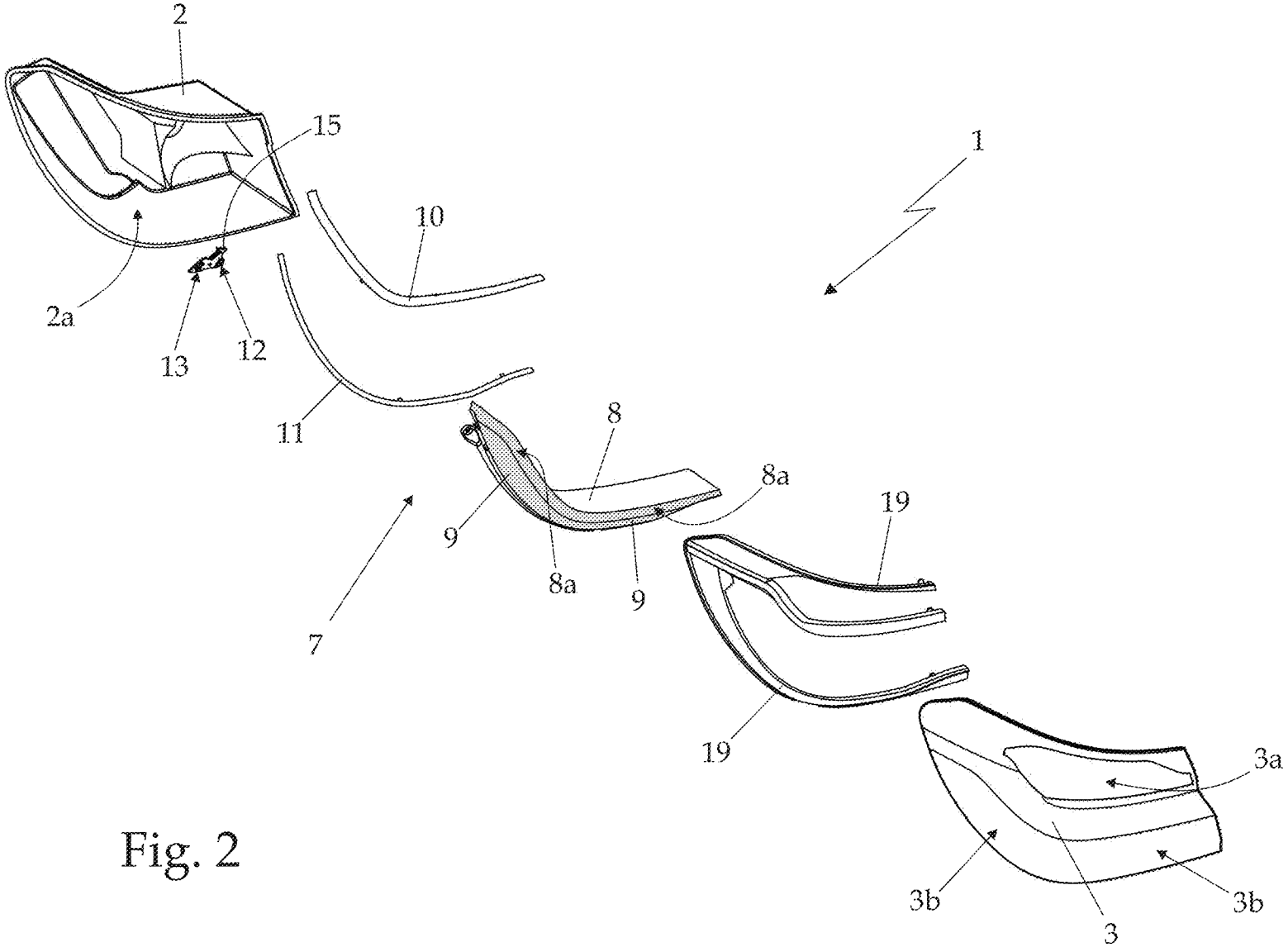
FIG. 2 is an exploded perspective view of the automotive light shown in FIG. 1.

With reference to FIGS. 1 and 2, number 1 indicates as a whole an automotive light particularly suited for being fixed on the rear of the body of a car, motorcycle or similar, i.e. a rear automotive light.

More in detail, in the example shown the automotive light 1 is preferably, though not necessarily, structured so as to be recessed into in the rear part of the body of a car, and comprises:

- a rigid rear body 2, which is substantially basin-shaped and is preferably structured so as to be recessed into a seat (not shown) specially made in the rear part of the vehicle body;
- a front lenticular semi-shell 3, which is arranged to close the mouth 2*a* of the rear body 2, preferably, though not necessarily, so as to surface, at the same time, from the vehicle body (not shown) and is provided with at least one, possibly coloured, transparent or semi-transparent portion; and
- one or more lighting assemblies, each of which is structured so as to emit light when electrically powered, and is arranged within the rear body 2 in a position such that it can backlight a corresponding transparent or semi-transparent portion of the front lenticular semi-shell 3.

More in detail, the front lenticular semi-shell 3 is preferably provided with at least one possibly coloured main transparent or semi-transparent portion 3*a*, which is preferably arranged so to be substantially facing/aligned with the rear part of the car when the automotive light 1 is recessed into the vehicle body; and at least one supplementary transparent or semi-transparent portion 3*b* with a narrow and elongated shape, i.e. a band-like shape, possibly coloured, which is preferably arranged on the front lenticular semi-shell 3 so as to at least partially flank the main transparent or semi-transparent portion(s) 3*a*.

In the example shown, in particular, rear body 2 is preferably made of an opaque plastic material, preferably by means of an injection moulding process. Instead, the front lenticular semi-shell 3 is preferably made of a transparent or semi-transparent plastic material, such as transparent or semi-transparent polycarbonate or polymethyl methacrylate for example, preferably by means of an injection moulding process in this case as well.

Obviously, in a different embodiment, rear body 2 could also be structured so as to simply cantilevered attached on the rear part of the vehicle body.

With reference to FIGS. 1 and 2, the lighting assembly suitable for backlighting the main transparent or semi-transparent portion 3*a* of the front lenticular semi-shell 3, hereinafter indicated by number 4, is located inside the rear body 2 immediately beneath the main transparent or semi-transparent portion 3*a*, and is preferably, though not necessarily, composed of

- an incandescent lamp 5 for automotive applications or another electrically powered light source, which is placed more or less close to bottom of the rear body 2, locally facing the main transparent or semi-transparent portion 3*a*; and optionally
- a cup-shaped reflector 6 preferably with a substantially parabolic profile, which is fitted on the lamp 5, obviously inside the rear body 2, with its mouth facing the main transparent or semi-transparent portion 3*a* of the lenticular semi-shell 3, and preferably having the inner surface metallized or otherwise mirror-like finished, so as to be able to reflect/direct the light produced by the lamp 5 directly towards the main transparent or semi-transparent portion 3*a* of the lenticular semi-shell 3.

More in detail, in the example shown, the cup-shaped reflector is preferably fixed to the rear body 2 in an irremovable manner immediately beneath the main transparent or semi-transparent portion 3*a* of the lenticular semi-shell 3; whereas the incandescent lamp 5 is preferably fixed to cantilevered project from removable lamp holder (not shown) which is arranged to close, in a substantially hermetic manner, a pass-through opening (not shown) specially made in the bottom of rear body 2, and is further structured so as to arranged at least the bulb of the lamp 5 within the cup-shaped reflector 6, close to the bottom of the cup-shaped reflector 6.

With reference to FIGS. 1 and 2, the lighting assembly suitable for backlighting the supplementary band-like, transparent or semi-transparent portion 3*b* of front lenticular semi-shell 3, hereinafter indicated by number 7, instead comprises a light-guiding plate 8 made of a photoconductive material, which more or less extends from the bottom of rear body 2 almost up to the back of the front lenticular semi-shell 3, locally remaining substantially perpendicular to the front lenticular semi-shell 3, and is also shaped so that its front lateral side 8*a* faces and is close to the supplementary band-like portion 3*b* of the front lenticular semi-shell 3, preferably for substantially the entire length of the supplementary band-like portion 3*b*.

In other words, the front lateral side 8*a* of light-guiding plate 8 follows/copies the profile of the band-like, transparent or semi-transparent portion 3*b* of the front lenticular semi-shell 3, always remaining close to the lenticular semi-shell 3 for substantially the entire length of the band-like, transparent or semi-transparent portion 3*b*.

However, differently from currently known automotive lights, the light-guiding plate 8 has a thickness locally less than the width of the supplementary band-like portion 3*b* of the front lenticular semi-shell 3, in such a way that its front lateral side 8*a* can cover only a first substantially band-like part of the supplementary band-like, transparent or semi-transparent portion 3*b* of the front lenticular semi-shell 3; and the lighting assembly 7 further comprises a second light-guiding plate 9 made of a photoconductive material, which rests on/is joined with one of the two larger faces of light-guiding plate 8, close to the front lateral side 8*a* of light-guiding plate 8, so as to form a substantially L-shaped structure, and locally extends substantially tangent to the lenticular semi-shell 3 so as to substantially completely cover the part of the supplementary band-like portion 3*b* of the lenticular semi-shell 3 left uncovered by the front lateral side 8*a* of light-guiding plate 8.

In the example shown, in particular, the light-guiding plates 8 and 9 are preferably, though not necessarily, made of Plexiglas, transparent polycarbonate or another similar plastic material, preferably by means of an injection moulding process. Furthermore, light-guiding plate 9 is preferably made in a single piece with light-guiding plate 8, so as to form a lateral winglet projecting from light-guiding plate 8.

With reference to FIGS. 1, 2, 3 and 4, the lighting assembly 7 preferably further comprises a first lighting device, which is structured so as to emit light when electrically powered, and is placed within the rear body 2 facing the rear lateral side 8*b* of light-guiding plate 8, so as to direct/convey the light produced by the same device towards the rear lateral side 8*b* of light-guiding plate 8; and a second lighting device, which is structured so as to emit light when electrically powered, and is placed within the rear body 2 facing the free lateral side 9*b* of light-guiding plate 9, so as to direct/convey the light produced by the same device towards the free lateral side 9*b* of light-guiding plate 9.

In the example shown, in particular, the first lighting device of lighting assembly 7 preferably comprises a first light-guiding section bar 10, oblong in shape and made of a photoconductive material, which extends inside the rear body 2, close to the rear lateral side 8*b* of light-guiding plate 8 (i.e. close to the lateral side of the light-guiding plate 8 facing towards the bottom of the rear body 2 and opposite to the front lateral side 8*a*) preferably substantially for the entire length of the rear lateral side 8*b*; and a first LED light source 12 or similar, which is structured so as to emit light when electrically powered and is placed within the rear body 2, close to one of the two ends of the light-guiding section bar 10, so as to direct the light produced directly inside the body of the light-guiding section bar 10. Light that then travels inside the light-guiding section bar 10 according to the same physical principles that govern light propagation in fibre-optic cables.

Similarly, the second lighting device of lighting assembly 7 preferably comprises a second light-guiding section bar 11, oblong in shape and made of a photoconductive material, which extends inside the rear body 2 close to the free lateral side 9*b* of light-guiding plate 9, preferably for substantially the entire length of the lateral side 9*b*; and a second LED light source 13 or similar, which is structured so as to emit light when electrically powered and is placed within the rear body 2, close to one of the two ends of the second light-guiding section bar 11, so as to direct the light produced directly inside the body of the light-guiding section bar 11. Light that then propagates inside the light-guiding section bar 11 according to the same physical principles that govern light propagation in fibre-optic cables.

Figure 3:
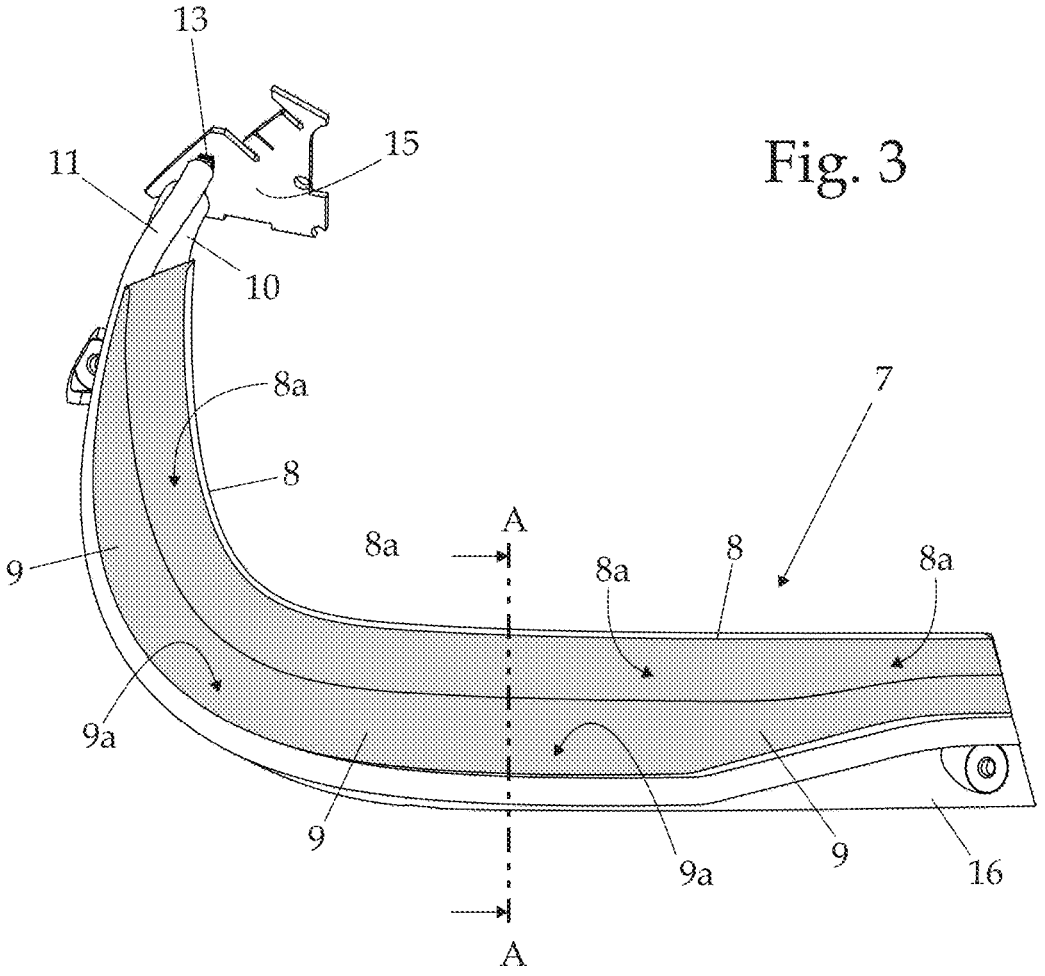
Figure 4:
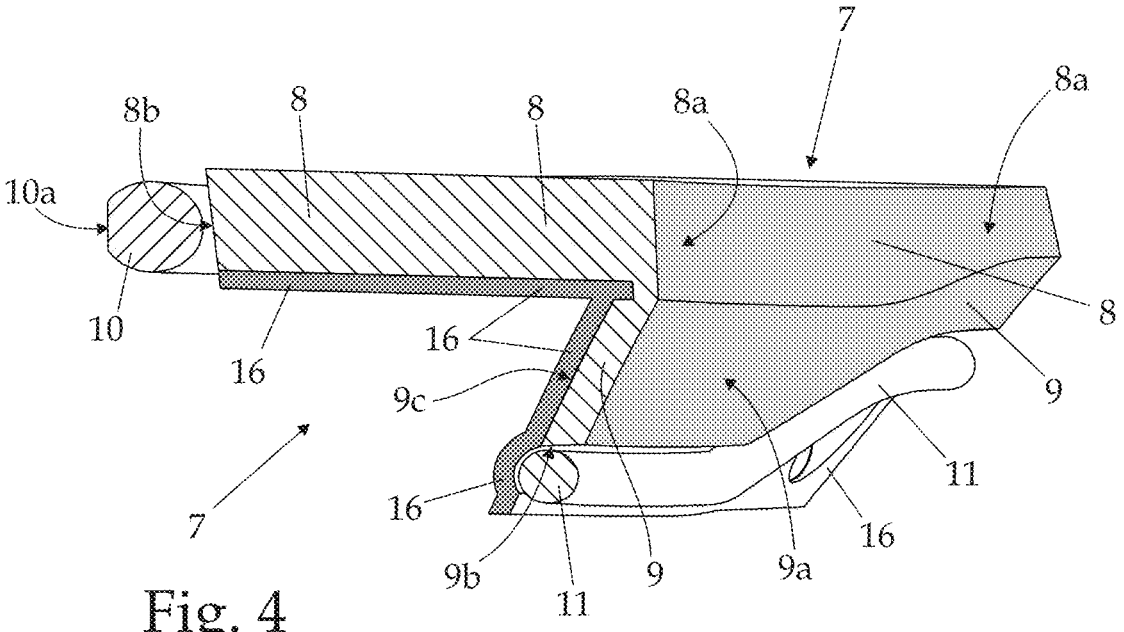
FIG. 4 is a cross-sectional view of the part of the light shown in FIG. 3, cut along section line A-A.

More in detail, with reference to FIGS. 2, 3 and 4, light-guiding section bar 10 extends inside rear body 2 so as be locally substantially tangent to the rear lateral side 8*b* of light-guiding plate 8, preferably substantially for the entire length of the same rear lateral side 8*b*, and is structured so as to progressively direct/convey the light coming from LED light source 12 to the rear lateral side 8*b* of light-guiding plate 8. The light then travels inside the body of light-guiding plate 8 according to the same physical principles that govern light propagation in fibre-optic cables, and comes out from light-guiding plate 8 through the front lateral side 8*a* of the same plate.

Instead, light-guiding section bar 11 extends inside the rear body 2 so as to be locally substantially tangent to the free lateral side 9*b* of light-guiding plate 9 preferably substantially for the entire length of the lateral side 9*b*, and is structured so as to progressively direct/convey the light coming from LED light source 13 to the lateral side 9*b* of light-guiding plate 9. The light then travels inside the body of light-guiding plate 9 according to the same physical principles that govern light propagation in fibre-optic cables, and then comes out from the front face 9*a* of light-guiding plate 9, i.e. from the face of light-guiding plate 9 that faces the front lenticular semi-shell 3.

Light-guiding plate 9 is actually structured to cause the controlled and progressive emission of the light that propagates inside the body of light-guiding plate 9, through the surface of the light-guiding plate 9 directly facing the front lenticular semi-shell 3.

In the example shown, in particular, the surface of the front face 9*a* of light-guiding plate 9 has a plenty of recesses or blind holes preferably, though not necessarily, having a lenticular profile and a diameter of less than a millimetre, which are able to deviate outwardly from the body of the plate those light rays that, bouncing inside the body light-guiding plate 9, reach/strike the surface of the plate at these recesses or blind holes.

Alternatively, the controlled emission of the light trapped inside the body of light-guiding plate 9 can be achieved by subjecting the surface of the plate to a surface abrasion (sandblasting), satinizing or silk-screen printing process so as locally increase the surface roughness of the light-guiding plate 9 and obtain a surface with a locally embossed profile.

With referring to FIG. 4, in the example shown, in particular, each light-guiding section bar 10, 11 preferably consists in a bar 10, 11 made of a photoconductive material and with a substantially circular or elliptical cross-section. Preferably, though not necessarily, the bar of photoconductive material that forms the light-guiding section bar 10 also has a substantially flat longitudinal light-extractor band 10*a*, which extends along the lateral side of the photoconductive-material bar opposite to the light-guiding plate 8, preferably substantially for the entire length of the bar.

Furthermore, in the example shown, the light-guiding section bars 10 and 11 are preferably, though not necessarily, made of Plexiglas, transparent polycarbonate or another similar plastic material, preferably by means of an injection moulding process.

Preferably, the two LED light sources 12 and 13 are instead constituted by two distinct light-emitting diodes, or groups of diodes, traditionally called LEDs, which are preferably located on a same support and power-supply board 15, which is placed close to the bottom of rear body 2; and the ends of the two light-guiding section bars 10 and 11 are shaped so as to converge to the support and power-supply board 15.

With reference to FIGS. 3 and 4, preferably the lighting assembly 7 is finally also provided with an opaque screening element 16 that covers the rear face 9*c* of light-guiding plate 9, i.e. the face of the light-guiding plate 9 facing the bottom of the rear body 2, so as to prevent the light rays travelling inside the body of light-guiding plate 9 from coming out from the body of light-guiding plate 9 through the rear face 9*c* of light-guiding plate 9.

More in detail, the opaque screening element 16 that covers the rear face 9*c* of light-guiding plate 9 is preferably structured so as to reflect/deviate towards the front face 9*a* of light-guiding plate 9 those light rays that, travelling inside the body of the light-guiding plate 9, strike the rear face 9*c* of light-guiding plate 9.

In the example shown, in particular, the opaque screening element 16 consists of a preferably white-coloured, plate-like body 16 which is coupled to light-guiding plate 9 so as to completely cover the rear face 9*c* of light-guiding plate 9, and which preferably also cantilevered extends beyond the free lateral side 9*b* of light-guiding plate 9 so as to support the light-guiding section bar 11 of lighting assembly 7 preferably along the entire length of the free lateral side 9*b* of light-guiding plate 9.

Preferably, though not necessarily, the opaque screening element 16, or better the plate-like body 16, is moreover structured so as to also cover the surface of the face of light-guiding plate 8 from which light-guiding plate 9 branches.

In the example shown, in particular, the plate-like body 16 is preferably made of an opaque plastic material, preferably by means of an injection moulding process that provides to over-inject the plate-like body 16 on top of the monolithic body formed by light-guiding plate 8 and light-guiding plate 9, or vice versa.

Preferably, the plate-like body 16 is thus made in a single piece with the monolithic body formed by light-guiding plate 8 and light-guiding plate 9.

With reference to FIGS. 1 and 2, the automotive light 1 preferably finally comprises a cover mask 19 made of an opaque material, which is located immediately beneath the front lenticular semi-shell 3 and is structured so as to hide the uncovered parts of the light-guiding section bar 11 of lighting assembly 7 that are close to the front lenticular semi-shell 3, and/or the two LED light sources 12 and 13 with the associated support board 15, and/or other walls of the lighting assembly 7.

General operation of automotive light 1 is easily inferable from the foregoing description and does not need further explanation.

Instead, with regard to lighting assembly 7, the selective and independent power supply for the two LED light sources 12 and 13 enables independently backlighting the two parts of the supplementary band-like, transparent or semi-transparent portion 3*b* of the front lenticular semi-shell 3, obtaining particularly innovative lighting effects.

In fact, powering LED light source 12 allows lighting the band of the supplementary band-like portion 3*b* immediately above the front lateral side 8*a* of the light-guiding plate 8, creating a particularly intense light beam.

Powering LED light source 13 allows backlighting substantially the entire supplementary band-like portion 3*b*, creating a medium-intensity light beam. The light that propagates inside light-guiding plate 9 is actually also able to reach light-guiding plate 8, from where it is emitted through the front lateral side 8*a* of the latter.

While the simultaneous powering of both LED light sources 12 and 13 allows backlighting substantially the entire supplementary band-like portion 3*b*, creating two adjacent bands of different intensity.

The advantages related to the particular structure of lighting assembly 7 are remarkable. The combined use of the two light-guiding plates 8 and 9 arranged in an L-shape allows producing supplementary band-like, transparent or semi-transparent portions 3*b* of any width on the front lenticular shell 3, while always ensuring optimal and homogeneous backlighting of the entire surface of the supplementary band-like portion 3*b*.

Finally, it is clear that modifications and variants can be made to the above-described automotive light 1 without departing from the scope of the present invention.

For example, in another less-sophisticated and not-shown embodiment, the first lighting device of lighting assembly 7 may consist of a series of light emitting diodes, traditionally called LEDs, which are placed in abutment on, or in any case facing, the rear lateral side 8*b* of light-guiding plate 8, and are oriented so as to direct the light produced towards the inside of the light-guiding plate 8 through the lateral side of the same plate. Similarly, the second lighting device of lighting assembly 7 may consists of a series of light emitting diodes, traditionally called LEDs, which are placed in abutment on, or in any case facing, the free lateral side 9*b* of light-guiding plate 9, and are oriented so as to direct the light produced towards the inside of the light-guiding plate 9 through the lateral side of the same plate.

The invention claimed is:

1. An automotive light (1) comprising a substantially basin-shaped rear body (2) structured so to be fixed onto the vehicle body; a front lenticular semi-shell (3), which is arranged to close the mouth (2*a*) of the rear body (2) and is provided with at least one band-like, transparent or semi-transparent portion (3*b*); and at least a first lighting assembly (7), which is structured so as to emit light when electrically powered, and is arranged within the rear body (2) so as to backlight the band-like, transparent or semi-transparent portion (3*b*) of the front lenticular semi-shell (3);

the automotive light (1) being characterized in that said first lighting assembly (7) comprises: a first light-guiding plate (8) made of photoconductive material and which substantially extends from the bottom of the rear body (2) up to and close to the front lenticular semi-shell (3), while remaining locally substantially perpendicular to said front lenticular semi-shell (3), and is furthermore shaped so as to arrange its front lateral side (8*a*) close to a first part of said band-like, transparent or semi-transparent portion (3*b*); and a second light-guiding plate (9) made of photoconductive material, which laterally rests on/is joined with one of the two larger faces of said first light-guiding plate (8), close to the front lateral side (8*a*) of the same first light-guiding plate (8), so as to form a substantially L-shaped structure, and locally extends substantially tangent to the front lenticular semi-shell (3) so as to substantially completely cover the remaining part of said band-like, transparent or semi-transparent portion (3*b*).

2. An automotive light according to claim 1, characterized in that the front lateral side (8*a*) of the first light-guiding plate (8) remains close to the front lenticular semi-shell (3) substantially over the whole length of said band-like, transparent or semi-transparent portion (3*b*).

3. An automotive light according to claim 1, characterized in that the second light-guiding plate (9) is made in one piece with the first light-guiding plate (8).

4. An automotive light according to claim 1, characterized in that the second light-guiding plate (9) is structured so as to cause the controlled, progressive emission of the light travelling into the body of the second light-guiding plate (9), through the surface (9*a*) of the second light-guiding plate (9) directly facing the front lenticular semi-shell (3).

5. An automotive light according to claim 1, characterized in that said first lighting assembly (7) comprises first lighting means (10, 12), which are structured so as to emit light when electrically powered, and are arranged within the rear body (2) facing the rear lateral side (8*b*) of the first light-guiding plate (8), so as to direct/convey the light produced towards the same rear lateral side (8*b*) of the first light-guiding plate (8).

6. An automotive light according to claim 5, characterized in that said first lighting means (10, 12) comprise a first light-guiding section bar (10), oblong in shape and made of photoconductive material, which extends inside the rear body (2) close to the rear lateral side (8*b*) of the first light-guiding plate (8); and a first light source (12), which is structured so as to emit light when electrically powered, and is arranged within the rear body (2), close to an end of the first light-guiding section bar (10), so as to direct the light produced directly into the body of the first light-guiding section bar (10).

7. An automotive light according to claim 6, characterized in that said first (12) and/or said second light sources (13) comprises one or more light emitting diodes.

8. An automotive light according to claim 5, characterized in that said first lighting means (10, 12) comprise a series of light emitting diodes, which are located in front of the rear lateral side (8*b*) of said first light-guiding plate (8) and are oriented so as to direct the light produced towards the inside of the first light-guiding plate (8) through the lateral side of the same plate.

9. An automotive light according to claim 1, characterized in that said first lighting assembly (7) comprises second lighting means (11, 13), which are structured so as to emit light when electrically powered and are arranged within the rear body (2) facing the free lateral side (9*b*) of the second light-guiding plate (9), so as to direct/convey the light produced towards the same free lateral side (9*b*) of the second light-guiding plate (9).

10. An automotive light according to claim 9, characterized in that said second lighting means (11, 13) comprise a second oblong in shape, light-guiding section bar (11) made of photoconductive material and which extends into the rear body (2) close to the free lateral side (9*b*) of the second light-guiding plate (9); and a second light source (13), which is structured so as to emit light when electrically powered and is arranged within the rear body (2), close to an end of the second light-guiding section bar (11), so as to direct the light produced directly into the body of the second light-guiding section bar (11).

11. An automotive light according to claim 9, characterized in that said second lighting means (11, 13) comprise a series of light emitting diodes, which are located in front of the free lateral side (9*b*) of said second light-guiding plate (9) and are oriented so as to direct the light produced towards the inside of the second light-guiding plate (9) through the lateral side of the same plate.

12. An automotive light according to claim 7, characterized in that the light emitting diode(s) forming the first light source (12) and the light emitting diode(s) forming the second light source (13) are located on a same support and power-supply board (15), which is arranged close to the bottom of the rear body (2); the ends of the first (10) and second light-guiding section bar (11) being shaped so as to converge towards said support and power supply board (15).

13. An automotive light according to claim 1, characterized by also comprising an opaque screening element (16), which covers the rear face (9*c*) of the second light-guiding plate (9) facing the bottom of the rear body (2).

14. An automotive light according to claim 13, characterized in that said opaque screening element (16) is structured so as to reflect/deviate towards the front face (9*a*) of the light-guiding plate (9) the light rays that strike the rear face (9*c*) of the light-guiding plate (9).

15. An automotive light according to claim 13, characterized in that said opaque screening element (16) comprises a plate-shaped body (16), which is coupled to the second light-guiding plate (9) so as to completely cover the rear face (9*c*) of the second light-guiding plate (9).

16. An automotive light according to claim 15, characterized in that said plate-shaped body (16) extends in a cantilever fashion beyond the free lateral side (9*b*) of said second light-guiding plate (9) so as to support said second lighting means (11, 13).

* * * * *